US011001927B2

(12) United States Patent
Raga et al.

(10) Patent No.: US 11,001,927 B2
(45) Date of Patent: May 11, 2021

(54) METHOD OF FORMING CORROSION RESISTANT COATING AND RELATED APPARATUS

(71) Applicants: PRATT & WHITNEY RZESZOW S.A., Rzeszów (PL); RZESZOW UNIVERSITY OF TECHNOLOGY, Rzeszów (PL)

(72) Inventors: Krzysztof Raga, Rzeszów (PL); Adam Baran, Rzeszów (PL); Kazimierz Kwolek, Markowa (PL); Monika Kocój-Toporowska, Rzeszów (PL); Anna Dryzner, Rzeszów (PL); Jan Sieniawski, Rzeszów (PL); Andrzej Sobkowiak, Rzeszów (PL); Przemysław Kwolek, Markowa (PL); Łukasz Florczak, Ostrowiec Świętokrzyski (PL); Marcin Drajewicz, Dukla (PL); Ginter Nawrat, Katowice (PL); Łukasz Nieużyła, Jaworzno (PL); Tomasz Wieczorek, Rogów (PL); Mirosław Dubiel, Gliwice (PL); Gabriela Lach, Ruda Śląska (PL); Agnieszka Krząkała, Ruda Śląska (PL)

(73) Assignees: PRATT & WHITNEY RZESZOW S.A., Rzeszow (PL); RZESZOW UNIVERSITY OF TECHNOLOGY, Rzeszow (PL)

( * ) Notice: Subject to any disclaimer, the term of this patent is extended or adjusted under 35 U.S.C. 154(b) by 461 days.

(21) Appl. No.: 15/689,367

(22) Filed: Aug. 29, 2017

(65) Prior Publication Data

US 2019/0003056 A1 Jan. 3, 2019

(30) Foreign Application Priority Data

Jun. 28, 2017 (EP) ..... 17461560

(51) Int. Cl.
*C25D 11/00* (2006.01)
*C25D 11/02* (2006.01)
(Continued)

(52) U.S. Cl.
CPC ..... *C23C 18/1208* (2013.01); *C23C 22/34* (2013.01); *C25D 11/005* (2013.01);
(Continued)

(58) Field of Classification Search
CPC ..... C25D 11/00; C25D 11/02; C25D 11/026
(Continued)

(56) References Cited

U.S. PATENT DOCUMENTS 5,147,515 A * 9/1992 Hanagata ..... C25D 13/02 204/164
5,264,113 A 11/1993 Bartak et al.
(Continued)

FOREIGN PATENT DOCUMENTS

DE 142360 A1 * 6/1980 ..... C25D 11/04
EP 2371996 A1 10/2011
TW 201506207 A * 2/2015 ..... C25D 11/12

OTHER PUBLICATIONS

European Search Report dated Feb. 1, 2018 for European Patent Application No. 17461560.9.

*Primary Examiner* — Edna Wong
(74) *Attorney, Agent, or Firm* — Bachman & LaPointe, P.C.

(57) ABSTRACT

A method of forming a corrosion-resistant ceramic coating on a metallic substrate, the method comprising providing a passivation layer on a surface of the metallic substrate by electrochemical passivation of the metallic substrate under a first electrical current and using a first electrically conducting solution; and providing the corrosion-resistant ceramic coating on an outermost surface of the metallic substrate, the
(Continued)

outermost surface in use adapted to be exposed to a corrosive environment, by plasma electrolytic oxidation of the metallic substrate with the passivation layer, in a second electrically conducting solution and under a second electrical current having a discharge voltage. The first and the second electrically conducting solutions comprise a tetrafluoroborate compound.

20 Claims, 19 Drawing Sheets

(51) Int. Cl.

| | |
|---|---|
| ***C23C 18/12*** | (2006.01) |
| ***C23C 22/34*** | (2006.01) |
| ***C25D 17/00*** | (2006.01) |
| ***C25D 21/02*** | (2006.01) |
| ***C25D 21/06*** | (2006.01) |
| ***C25D 21/12*** | (2006.01) |
| ***C25D 17/04*** | (2006.01) |
| ***C25D 11/30*** | (2006.01) |
| ***C25D 11/12*** | (2006.01) |
| ***C25D 11/26*** | (2006.01) |

(52) U.S. Cl.
CPC ..... *C25D 11/024* (2013.01); *C25D 11/026* (2013.01); *C25D 11/12* (2013.01); *C25D 11/26* (2013.01); *C25D 11/30* (2013.01); *C25D 17/007* (2013.01); *C25D 17/04* (2013.01); *C25D 21/02* (2013.01); *C25D 21/06* (2013.01); *C25D 21/12* (2013.01); *C23C 2222/20* (2013.01)

(58) Field of Classification Search
USPC ..... 205/170, 171
See application file for complete search history.

(56) References Cited

U.S. PATENT DOCUMENTS

| | | | | |
|---|---|---|---|---|
| 5,266,412 | A * | 11/1993 | Bartak | C25D 11/30 428/472 |
| 5,811,194 | A | 9/1998 | Kurze et al. | |
| 6,322,689 | B1 * | 11/2001 | Omasa | C25D 11/02 204/222 |
| 6,818,313 | B2 * | 11/2004 | Phelps | C23C 18/52 106/1.17 |
| 2003/0188972 | A1 | 10/2003 | Shatrov et al. | |
| 2005/0115839 | A1 | 6/2005 | Dolan | |
| 2012/0000783 | A1 * | 1/2012 | Suda | C25D 11/026 205/50 |
| 2016/0097329 | A1 | 4/2016 | Shmyreva et al. | |
| 2017/0029959 | A1 | 2/2017 | Lu et al. | |

* cited by examiner

METHOD OF FORMING CORROSION RESISTANT COATING AND RELATED APPARATUS

CROSS-REFERENCE TO RELATED APPLICATIONS

The present application claims priority on European Patent Application No. 17461560.9 filed Jun. 28, 2017, the entire content of which is incorporated herein by reference.

TECHNICAL FIELD

The present relates generally to corrosion resistant coatings for metal substrates, and more particularly to methods for forming ceramic coatings having high corrosion protection and wear resistance.

BACKGROUND

Spark discharge oxidation is a plasma electrolytic oxidation process used to form oxide coating on metallic substrate. Plasma electrolytic oxidation allows hard ceramic coatings to be applied on diverse metallic alloys. Microdischarges occurring on the electrode surface during the process promotes the creation of ceramic oxides phases, which may improve mechanical properties of the coating.

However, if the metallic substrate to be coated has a complicated spatial shape, a complicated surface configuration, through holes, and/or blind holes, obtaining a uniform coating over the surface of the substrate can be challenging.

SUMMARY

There is accordingly provided, in accordance with an aspect of the present invention, a method of forming a corrosion-resistant ceramic coating on a metallic substrate, the method comprising: providing a passivation layer on a surface of the metallic substrate by electrochemical passivation of the metallic substrate under a first electrical current and using a first electrically conducting solution; and forming the corrosion-resistant ceramic coating on an outermost surface of the metallic substrate by plasma electrolytic oxidation of the metallic substrate with the passivation layer, in a second electrically conducting solution and under a second electrical current having a discharge voltage, the outermost surface in use adapted to be exposed to a corrosive environment; wherein the first and the second electrically conducting solutions comprise a tetrafluoroborate compound.

The method as described above may further include selecting the tetrafluoroborate compound from the group comprising potassium tetrafluoroborate, sodium tetrafluoroborate, lithium tetrafluoroborate and ammonium tetrafluoroborate In the method as described above, the electrochemical passivation and the plasma electrolytic oxidation may be performed separately, and the first and the second electrically conducting solutions are different solutions.

In one particular embodiment, the first electrically conducting solution has a tetrafluoroborate concentration of 0.1-50 g/L. In another more particular embodiment, the second electrically conducting solution has a tetrafluoroborate concentration of 0.1-20 g/L.

In the method as described above, at least the second electrically conducting solution may be circulated to flow around the substrate.

In the method as described above, the substrate may be moved during at least plasma electrolytic oxidation in the second electrically conducting solution, and the substrate may further be continuously moved.

In the method as described above, the substrate may be moved by continuous flow of the first electrically conducting solution and/or the second electrically conducting solution around the substrate.

In the method as described above, the plasma electrolytic oxidation may be an electrolytic spark discharge oxidation and the discharge current is injected through the second solution by impulse, each impulse having an impulse time divided into a flow-on time, during which a current passes through the second solution, and a flow-off time, during which no current passes through the second electrically conducting solution, wherein the ratio between the flow-on time and the impulse time is of from 10% to 100%. The ratio between the flow-on time and the impulse time may also be from 30% to 40%.

The method as described above may further include adapting a distance between the outermost surface of the substrate to be coated, and at least one electrode delivering at least one of the first electrical current and the second electrical current.

The method as described above may also, alternately, including providing the passivation layer and the corrosion-resistant ceramic coating in a single step. The electrochemical passivation is a first stage of the plasma electrolytic oxidation, the first and the second electrically conducting solutions are a single and same solution; and the passivation layer is provided during onset of the electrical current up to the discharge voltage.

In accordance with another aspect of the present invention, there is also provided an apparatus for forming a corrosion-resistant ceramic-oxide coating on a metallic substrate, the apparatus comprising: an electrolytic cell including a housing containing an electrically conducting solution and adapted to receive the metallic substrate therein; and an anode and a cathode that are spaced apart and operable to supply current though the electrically conducting solution between the anode and the cathode; and wherein the electrically conducting solution comprises at least one tetrafluoroborate compound.

In the apparatus as described above, the tetrafluoroborate compound may be selected from the group comprising potassium tetrafluoroborate, sodium tetrafluoroborate, lithium tetrafluoroborate and ammonium tetrafluoroborate.

In the apparatus as described above, the electrically conducting solution may have a tetrafluoroborate concentration of 0.1-50 g/L.

The apparatus as described above may further include a mounting assembly comprising: an upper arm connected in electrical contact to the anode; and a lower arm having a first end connected in electrical contact to the upper arm and a second end adapted to be connected in electrical contact to the substrate to be coated, the lower arm being movable relative to the upper arm to allow movement of the substrate within the electrically conducting solution.

In a particular embodiment, the lower arm is pivotably connected to the upper arm as to be movable in an upright direction between at a first position and at least one second position, the first and second positions being angularly separated by an angle of from 90 to 135°.

The apparatus as described above may further include a cathode frame having a plurality cathode frame portions, each cathode frame portion being disposed along a wall of the housing and being removably connected to at least another of the cathodes frame portions, the cathodes frame portions having reversible connecting features as to be movable relative to each other, the cathode comprising a plurality of cathode plates connected to the cathode frame portions and disposed around the housing.

The apparatus as described above may further include: a filter connected to the electrolytic cell and adapted to filter a stream of the electrically conducting solution received from the electrolytic cell; a heat exchanger connected downstream the filter and upstream the electrolytic cell, the heat exchanger being adapted to remove heat from the stream of the electrically conducting solution exiting the filter before the stream is circulated back to the electrolytic cell; and a flow generating device operably connected to the electrolytic cell as to circulate the electrically conducting solution around the substrate, from the electrolytic cell to the filter and the heat exchanger, and from the filter and heat exchanger back to the electrolytic cell. The flow generating device may be a pump, the pump including a compressor operable to supply a gas and circulate the electrically conducting solution.

DESCRIPTION OF THE DRAWINGS

Reference is now made to the accompanying figures in which.

DETAILED DESCRIPTION

A method of treating a substrate to form a corrosion-resistant coating, such as a corrosion-resistant ceramic oxide coating, is described herein. Ceramic coatings, and more particularly ceramic oxide coatings, are sometimes used in applications when the coated component may be exposed to corrosive and/or wear conditions. For example, the corrosion-resistant coating can be formed on a component of a gas turbine engine.

It is known that the components of a gas turbine engine operate under harsh conditions: high temperatures, erosion of fly ash and sand particles, wear out of adjacent moving surfaces, oxidation and corrosion produced by the passage of hot combustion gas, etc. Therefore, certain components of a gas turbine engine may be protected by a corrosion-resistant coating.

Figure 1:
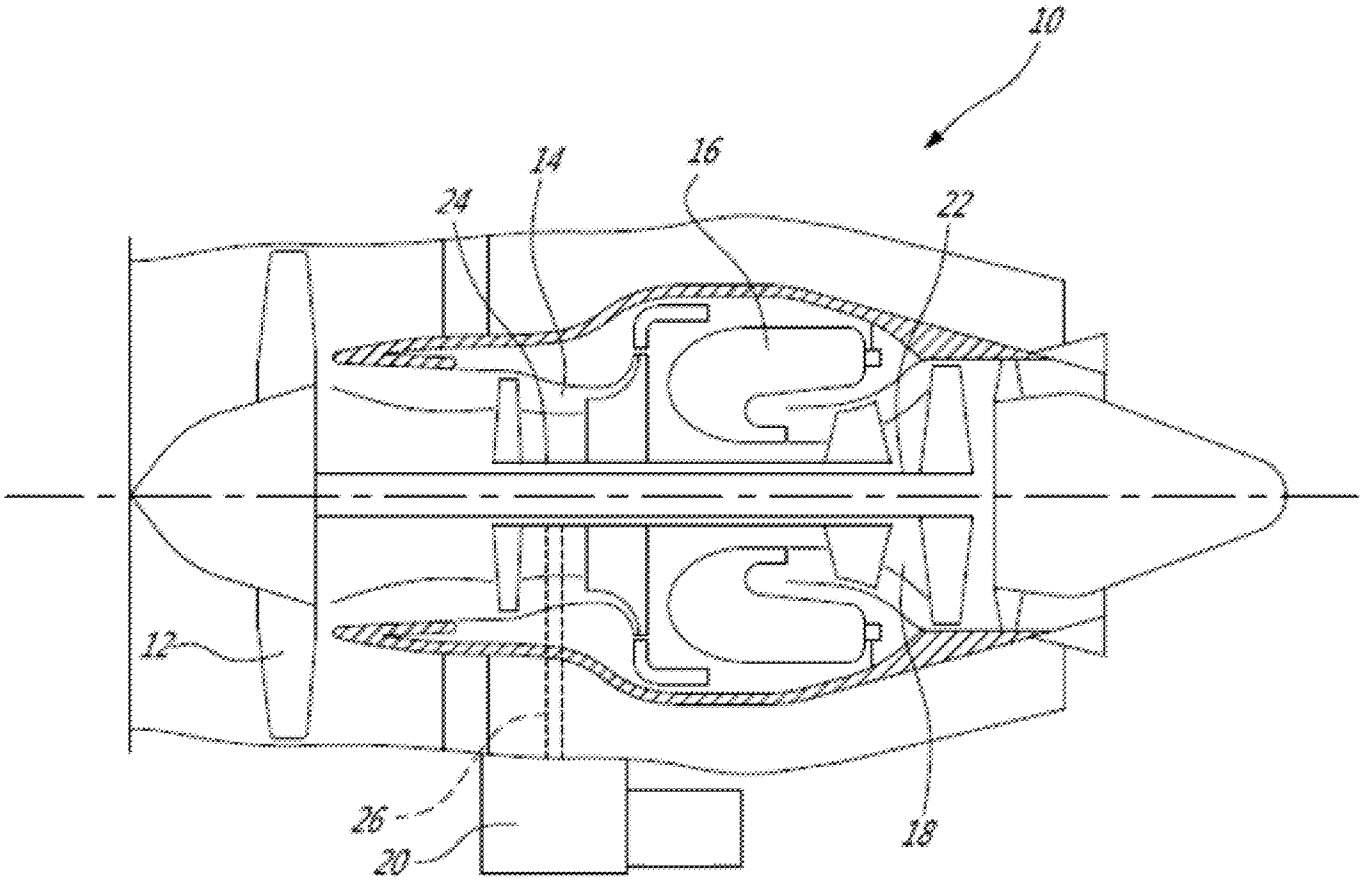
FIG. 1 is a schematic cross-sectional view of a gas turbine engine.

Referring to FIG. 1, a gas turbine engine 10 is shown, which may for example be provided for use in subsonic flight. The gas turbine engine 10 generally comprises in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases. The gas turbine engine 10 may comprise a gearbox 20 mechanically coupled to a shaft of engine 10, such as low-pressure shaft 22 and high-pressure shaft 24. The gearbox 20 may serve to extract power from engine 10 in order to drive one or more accessories of the gas turbine engine 10.

The coated substrate as described herein can therefore be a surface of a component of such a gas turbine engine 10, such as casing or housing thereof. For example, the component having a coated surface may include a gearbox housing, a gas generator casing, or a turbine casing, and the like, wherein wear resistance and corrosion protection is desired. Referring to FIG. 1, the corrosion-resistant coating can be formed on the different component of the gas turbine engine 10, i.e. on a housing of gearbox 20, on a casing of compressor 14 or of combustor 16, on a blade of the gas turbine section 18, etc.

As can be seen in FIG. 1, the components of a gas turbine engine have diverse shape and more or less complex features so that the substrate to be coated can have any particular shape, from a linear and/or simple shape to a complicated spatial shape. For example the substrate can includes indentations, recesses, holes, bumps, protruding parts, or any other complex features.

In a particular embodiment, the substrate is a metallic based substrate. For example, magnesium substrates, titanium substrates or aluminum substrates are generally used in aviation industry. The substrate can thus comprise magnesium, titanium, aluminum or any alloys thereof. In other industries the metallic substrate can comprise valve metal, such as vanadium, tungsten, zirconium, niobium, hafnium, tantalum or stainless steel.

The method comprises the step of providing a first pre-treatment layer (hereafter "the first layer"), also called a passivation layer, on a surface of the substrate. The substrate can be immersed in a first electrically conducting solution (hereafter "the first solution") while applying electrical current through the first solution. Such process is generally performed in an electrolytic cell comprising electrodes, and wherein a current is applied between the electrodes (i.e. the anode and the cathode).

The first solution, as used in the present method, comprises tetrafluoroborate ionic compound. The tetrafluoroborate ionic compound can be one of potassium tetrafluoroborate, sodium tetrafluoroborate, lithium tetrafluoroborate and ammonium tetrafluoroborate.

It is understood that the tetrafluoroborate ionic compound is an additive introduced in a pre-existing electrically conducting solution. For example, the tetrafluoroborate ionic compound can be added in a solution of fluoride ionic compound. Therefore, the first solution can comprise both tetrafluoroborate ionic compound and fluoride ionic compound. The cation of the fluoride ionic compound generally correspond to the cation of the tetrafluoroborate compound. For example, depending on the tetrafluoroborate ionic compound to be used, the first solution can be one of a solution of potassium fluoride, sodium fluoride, lithium fluoride, and ammonium fluoride.

Figure 2:
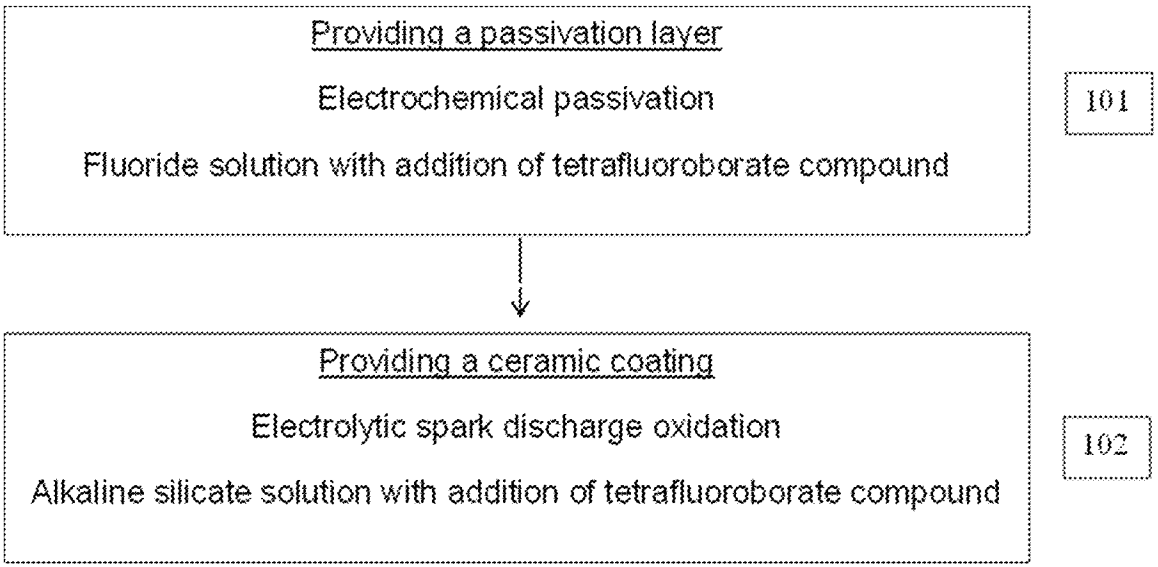
FIG. 2 is a flow chart of a method for forming a corrosion-resistant ceramic-oxide coating on a metallic substrate according to an embodiment of the present disclosure.

Referring to the particular embodiment of FIG. 2, the passivation layer can be provided using electrochemical passivation in the first solution containing a fluoride ionic compound and tetrafluoroborate ionic compound (step 101). In such case the first layer is a fluoride layer. The nature of the fluoride layer depends on the type of metal of the substrate. For example, in case of a magnesium substrate, the first layer is a magnesium fluoride layer. Therefore, electrochemical passivation of the metallic substrate can provide a homogeneous and uniform layer consisting of magnesium fluoride on a surface of the substrate.

The first fluoride solution with tetrafluoroborate additives allows the formation of a fully passivated surface on the metallic substrate. In the first solution, the concentration of fluoride compounds can be between 0.5 and 200 g/L. In a more specific embodiment, the concentration of fluoride compounds is between 20 and 60 g/L. In a further more specific embodiment, the concentration of tetrafluoroborate compounds is be between 0.1 and 20 g/L, and may be for example between 0.5 and 5 g/L.

In one embodiment, the first solution comprises potassium fluoride at 0.5-200 g/L and potassium tetrafluoroborate at 0.1-20 g/L. In another embodiment, the solution comprises sodium fluoride at 0.5-200 g/L and sodium tetrafluoroborate at 0.1-20 g/L. In a further embodiment, the solution comprises lithium fluoride at 0.5-200 g/L and lithium tetrafluoroborate at 0.1-20 g/L. In yet a further embodiment, the solution comprises ammonium fluoride at 0.5-200 g/L and ammonium tetrafluoroborate at 0.1-20 g/L.

The immersion of the substrate in the first solution can be performed under stable voltage. It is contemplated that the electrical parameters of the passivation process can be determined as to optimize the formation of the first layer. In a particular embodiment, the current used for the electrochemical passivation has a voltage of between 1 and 120 V. In one particular embodiment, the voltage is about 50 V. Constant voltage, direct current, or impulse current can be applied. The anodic current density can be self-setting and successively decreasing as electrochemical passivation runs. In a particular embodiment, the anodic current density starts from 10 $A/dm^2$ and achieves, at the end phase, about 0.01 $A/dm^2$. In another embodiment, the anodic current density achieves about 0.001 $A/dm^2$ at the end phase. The temperature of the first solution in the electrochemical passivation is kept between 0 and 100° C. In a particular embodiment, the first solution is kept at about 20° C.

The method then comprises the step of providing the corrosion-resistant ceramic coating by treating the substrate with the first layer. The ceramic coating is formed on an outermost surface of the substrate, and provides protection against corrosion and wear. The term «outermost surface» to the surface of the metallic substrate being, in use, likely to be exposed to a corrosive environment.

The corrosion-resistant ceramic coating may be formed by plasma electrolytic oxidation of the substrate covered with the first layer. Plasma electrolytic oxidation is an electrochemical treatment allowing the formation of oxide coating on surfaces. This process generally uses voltages higher than those used in the electrochemical pre-treatment passivation.

It is understood that the first layer applied during the first passivation step provides higher stability during the plasma electrolytic oxidation operating and better properties of the ceramic coatings. For example, a fluoride layer allows obtaining better properties for the outermost ceramic coating such as lower surface roughness, lower scattering of the ceramic coating so that the thickness of the ceramic coating stays within tolerance band. The presence of the fluoride layer also decrease the onset time for the electrolytic spark discharge oxidation, thereby increasing of the yield of the process.

Still referring to FIG. 2, in a particular embodiment, providing the ceramic coating by treating the first layer (step 102) comprises immersing the substrate, previously treated by electrochemical passivation, in a second electrically conducting solution (hereafter "the second solution") while applying current through the second solution, using a pair of electrodes. The plasma electrolytic oxidation can be an electrolytic spark discharges oxidation process, in which discharges are generated by impulse current generator. In the process of FIG. 2, it is believe that the first layer that is previously formed on the metallic substrate is dissolved by the plasma electrolytic oxidation. Chemical reaction then occurs between the metallic substrate and the electrolytes in the second solution during dissolution of the first layer. The electrochemical reaction leads to the growth of an oxide layer on an outermost surface of the substrate and to the formation of the corrosion-resistant coating.

The second solution also comprises tetrafluoroborate ionic compounds additive, wherein the tetrafluoroborate compounds can be at least one of potassium tetrafluoroborate, sodium tetrafluoroborate, lithium tetrafluoroborate and ammonium tetrafluoroborate. The concentration of tetrafluoroborate compounds in the second solution can be between 0.1 and 50 g/L. In a particular embodiment, the concentration of tetrafluoroborate compounds is between about 0.5 and about 5 g/L.

It is understood that the tetrafluoroborate compound is an additive introduced in a pre-existing electrically conducting solution. For example, as shown in FIG. 2, the tetrafluoroborate compound can be added in a solution of hydroxide and silicate ionic compounds (referred to as alkaline silicate solution in FIG. 2). Therefore, the second solution can comprise a tetrafluoroborate compound, an hydroxide compound and a silicate compound. For example, the second solution can comprise at least one of sodium hydroxide, potassium hydroxide, or lithium hydroxide. The concentration of hydroxide compounds may be in the range of 1 to 20 g/L. In a particular embodiment, the concentration of hydroxide compounds is between about 2 and about 8 g/L. Also, the second solution can comprise at least one of sodium silicate, potassium silicate, or lithium silicate, which concentration may be in the range of 1 to 100 g/dm$^3$. In a particular embodiment, the concentration of the at least one of sodium silicate, potassium silicate, or lithium silicate, is between about 2 and about 20 g/L. The cation of the hydroxide ionic compound and the silicate ionic compound generally correspond to the cation of the tetrafluoroborate ionic compound. However, the cation of the hydroxide compound and of the silicate compound could also be different from the cation of the tetrafluoroborate compound.

In one embodiment, the second solution comprises potassium hydroxide at 1-20 g/L, potassium silicate at 1-100 g/L and potassium tetrafluoroborate at 0.1-50 g/L. In another embodiment, the second solution comprises sodium hydroxide at 1.0-20 g/L, sodium silicate at 1-100 g/L and sodium tetrafluoroborate at 0.1-50 g/L. In a further embodiment, the second solution comprises lithium hydroxide at 1-20 g/L, lithium silicate at 1-100 g/L and lithium tetrafluoroborate at 0.1-50 g/L. In yet a further embodiment, the second solution comprises one of potassium, sodium and lithium hydroxide at 1-100 g/L, one of potassium, sodium and lithium silicate at 1-50 g/L and ammonium tetrafluoroborate at 0.1-50 g/L.

Figure 3:
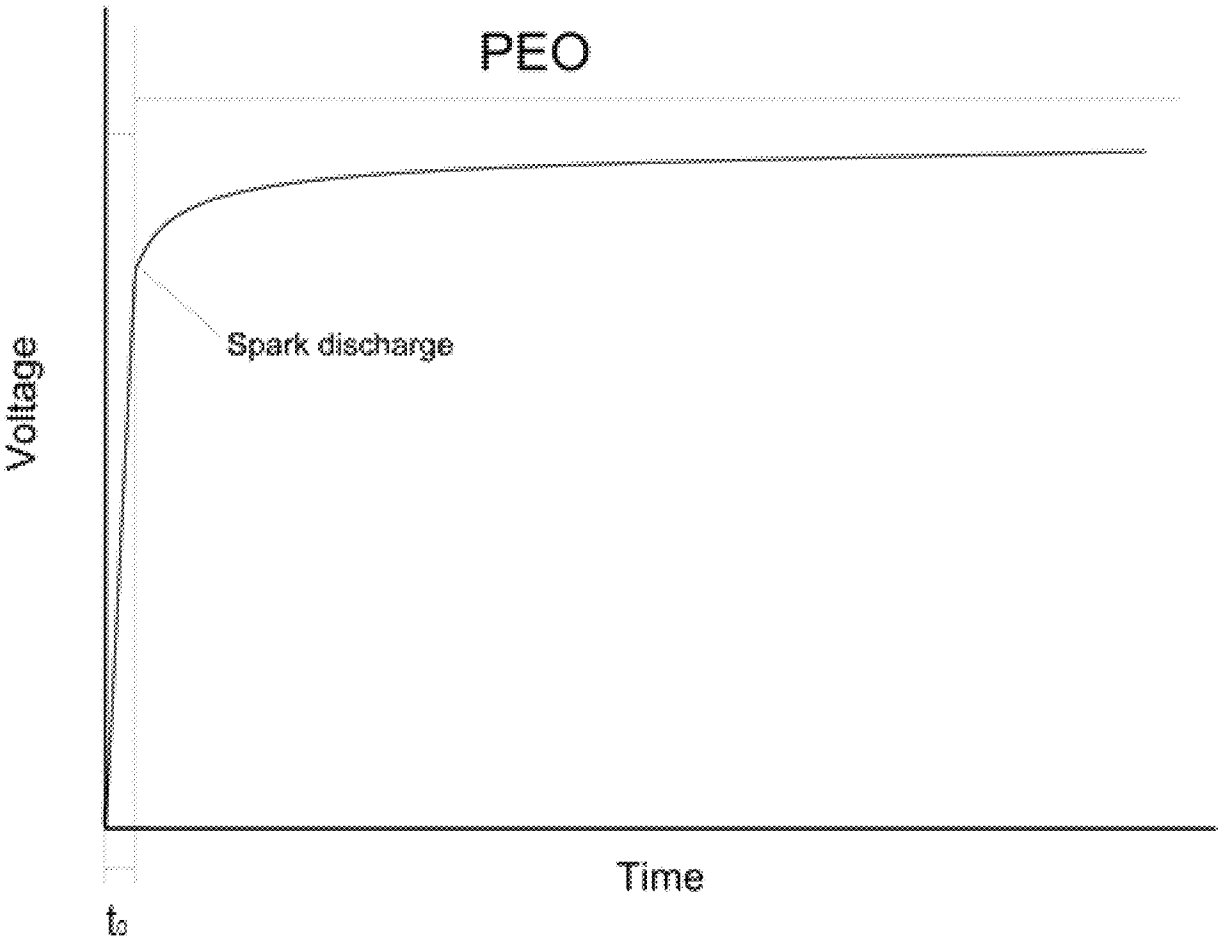
FIG. 3 is a graph of Voltage vs. Time depicting the onset of a current run during a method for forming a corrosion-resistant ceramic-oxide coating on a metallic substrate according to an embodiment of the present disclosure.

Therefore, in the particular embodiment of FIG. 2, the first layer and the second layer are formed in separate steps (electrochemical passivation and plasma electrolytic oxidation), using different electrically conducting solutions. As shown in FIG. 3, the formation of the first layer in a separate step, before starting the plasma electrolytic oxidation (PEO) process, eliminates the progressive increase of the voltage of the electrical current at the beginning of the plasma electrolytic process. As mentioned above it is contemplated that the presence of the fluoride layer formed during electrochemical passivation decrease the onset time for the electrolytic spark discharge oxidation, thereby increasing of the yield of the process. The voltage has a discharge (also referred to as spark-discharge) value after a short time to, and the formation of the corrosion-resistant ceramic layer can start immediately. The term "discharge voltage" is intended to mean a voltage allowing plasma electrolytic oxidation, and more particularly the electrolytic spark-discharge oxidation, to occur. Such discharge voltage are generally between 100 V and 600 V.

Figure 4:
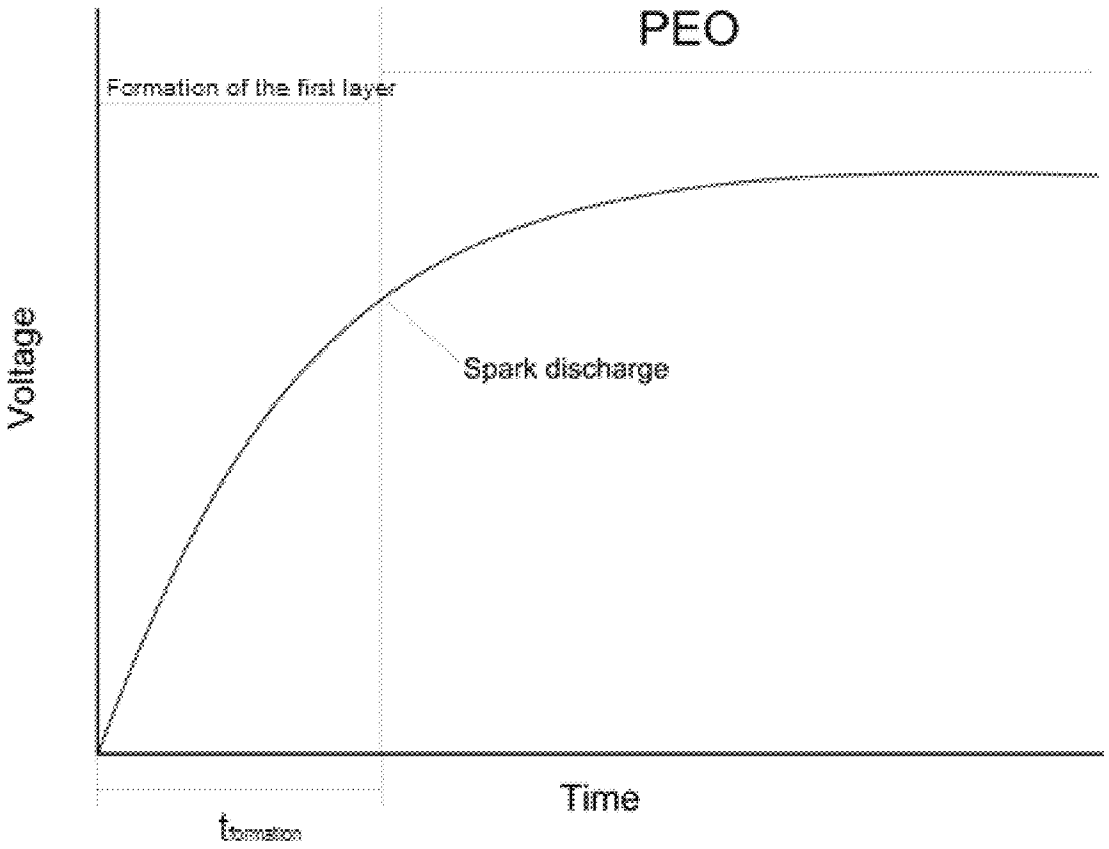
FIG. 4 is a graph of Voltage vs. Time depicting the onset of a current run during a method for forming a corrosion-resistant ceramic-oxide coating on a metallic substrate according to another embodiment of the present disclosure.

In another particular embodiment, the first layer is formed in a first stage of a plasma electrolytic oxidation process, while the voltage of the electrical current is progressively increased. In such case, the first layer can be an oxide layer, such as a magnesium oxide layer, a titanium oxide layer, an aluminum oxide layer, etc., depending on the type of metallic substrate to be coated. FIG. 4 shows that the formation of the first layer occurs during the progressive and slow onset of the voltage of the electrical current applied, until the voltage reach a spark-discharge voltage. In FIG. 4, the time $t_{formation}$ corresponds to the formation of the first layer. Then the voltage reaches a plateau and the plasma electrolytic oxidation process takes place, leading to the formation of the ceramic coating. In this case, the formation of the first layer allows to produce the final ceramic coating and it is believe that the first layer is incorporated in the corrosion-resistant ceramic coating. It is clear from a comparison of FIGS. 3 and 4 that the time to (the time needed to reach the spark-discharge voltage when the first layer and the ceramic coating are formed in separate processes), is smaller than the time $t_{formation}$ (the time needed for the formation of the first layer, when the first layer is formed as a first stage of the plasma electrolytic oxidation).

In the process of electrolytic spark discharge oxidation, constant or impulse current of monopolar or bipolar nature can be applied. The current may be monopolar impulse nature. The impulse current may have a frequency of from 0.01 kHz to 10 kHz. In a particular embodiment, the impulse current is between about 0.5 kHz and about 1 kHz. The voltage of the current applied may be from 100 V to 600 V. In a particular embodiment, the voltage is between about 200 V and about 450 V. In addition, the anodic current density is between 0.1 A/dm$^2$ and 20 A/dm$^2$. In a particular embodiment, the anodic current density is between about 2 A/dm$^2$ and about 10 A/dm$^2$. The temperature of the second solution during plasma electrolytic oxidation may be kept between 0 and 60° C. In a particular embodiment, the temperature of the second solution is kept between about 3 to about 7° C.

Figure 5:
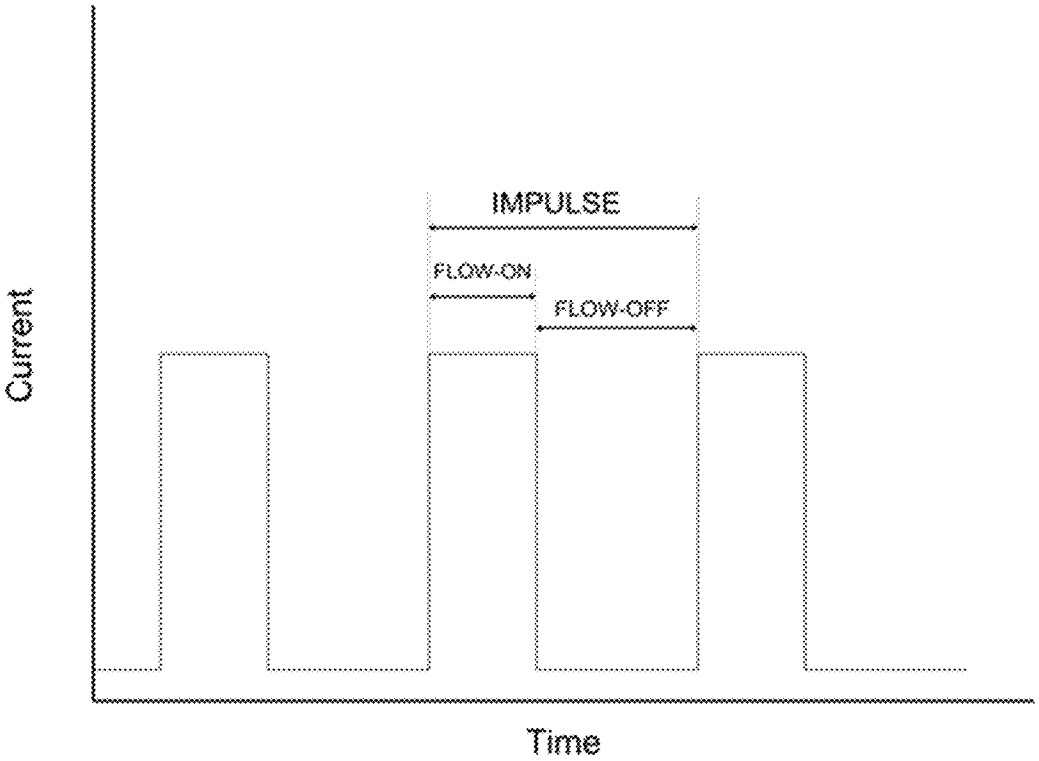
FIG. 5 is a graph of Current vs. Time depicting an impulse current run during the method of FIG. 2.

As shown in FIG. 5, each current impulse is applied during a time that can be divided in two time segments: a first time called the "flow-on time", during which current flows through the second solution, and a second time called the "flow-off time", during which the current is stopped. The ratio of the flow-on time to the total time of a complete impulse is called "duty cycle". In a particular embodiment, the duty cycle value of the electrolytic spark discharge oxidation varies from 10% to 100%. In a particular embodiment, the duty cycle value varies between about 30% and about 40%. It is contemplated that application of an impulse current having the aforementioned duty cycle allows improving the uniformity of the thickness of the corrosion-resistant coating.

Figure 6:
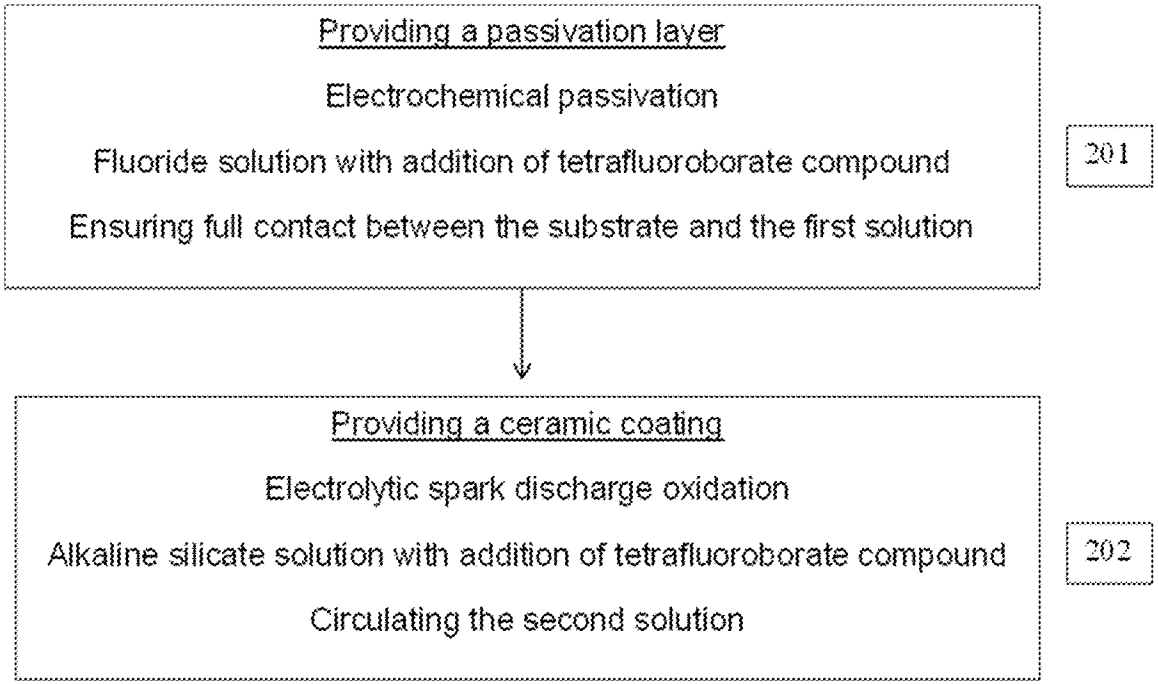
FIG. 6 is a flow chart of a method for forming a corrosion-resistant ceramic-oxide coating on a metallic substrate according to another embodiment of the present disclosure.

The method can further comprise circulating at least one of the first and the second solution around the substrate during the formation of the first layer and/or during the treatment of the substrate having the first layer to provide the ceramic coating. However, while providing the first layer it may be sufficient to solely ensure full contact between the substrate and the first solution. The circulation of the first and/or the second solution can be continuous or intermittent. For example, pumps or compressors can be used to put the first solution and/or the second solution into motion. Moving the first and/or the second solution around the substrate maximizes the contact between the electrolytes in the respective one of the first and/or the second solution and the surface of the substrate In the particular embodiment of FIG. 6, full contact between the substrate and the first solution is ensured during the formation of the first layer (201), while the second solution is circulated around the substrate during the formation of the ceramic coating (202).

The method can further comprise moving the substrate in at least one of the first solution and the second solution during the formation of the first layer and/or during the treatment of the substrate having the first layer to provide the ceramic coating. As mentioned above, while providing the first layer it can be sufficient to solely ensure full contact between the substrate and the first solution.

Figure 7:
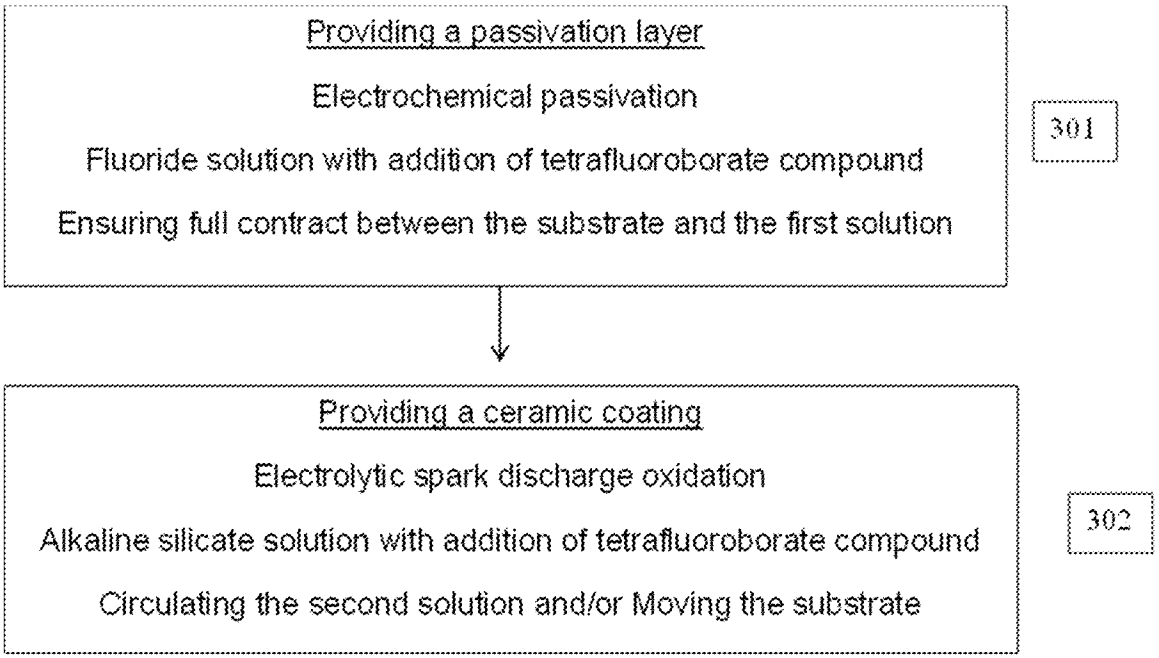
FIG. 7 is a flow chart of a method for forming a corrosion-resistant ceramic-oxide coating on a metallic substrate according to a further embodiment of the present disclosure.

In the embodiment of FIG. 7, the substrate is moved solely during the formation of the ceramic coating 302. During formation of the first layer (step 301), the substrate is immersed in the first solution, which can be either motionless or circulating around the substrate. The full contact between the substrate and the first solution (for example by prevention of gas pockets) is ensured. During step 302, circulation of the second solution and/or movement of the substrate allows obtaining an homogeneous and uniform ceramic coating.

It is understood that the substrate can be moved using any suitable techniques. For example, the first and/or the second solution can be circulated around the substrate using pumps or compressors and the flow generated can put the substrate into motion. The substrate could also be moved by an mechanical device generating an automatic movement of the substrate in the first and/or the second solution. Moving the substrate within the first and/or the second solution allows the formation of a coating having a uniform thickness and reproducible properties regardless of the geometry of the substrate.

The method can also comprise adapting the distance between the electrode delivering the electrical current during at least one of the electrochemical passivation and plasma electrolytic oxidation. For example the cathode may be moved closer to the substrate to be coated depending on the size and shape of the metallic substrate. It is contemplated that moving the electrode, and more particularly the cathode, allow to further improve the uniformity of the ceramic coating formed on the outermost surface of the substrate.

The thickness of the corrosion-resistant coating formed by the present method depends on the parameters used: voltage, frequency, concentration of the electrolytes and additives in the first and second solutions, duration of the electrolytic arc-discharge oxidation process, duty cycle, circulation of the first and/or second solution, motion of the substrate, etc. For example the thickness of the corrosion resistant coating can be between 5 and 20 μm. In a particular embodiment, the corrosion resistant ceramic coating obtained has a thickness of about 10±2 μm after 10 to 20 minutes of the electrolytic spark discharge oxidation with average value of current density equal to 2-5 A/dm$^2$, current frequency 0.5-2 kHz, and duty cycle of 20 to 40%. The substrate coated with said 10 μm corrosion-resistant ceramic coating can resist from 220 hours to 240 hours when tested in standard salt chamber (5% water solution of sodium chloride, at 35° C.).

The corrosion-resistant coating resulting from the present method can comprise magnesium fluoride, magnesium oxide, magnesium fluoro-oxide and silicon dioxide. Such materials are resistant to corrosion and abrasion thereby providing a wear resistant and corrosion resistant coating.

An apparatus for forming a corrosion-resistant ceramic-oxide coating on a metallic substrate is also described.

Figure 8:
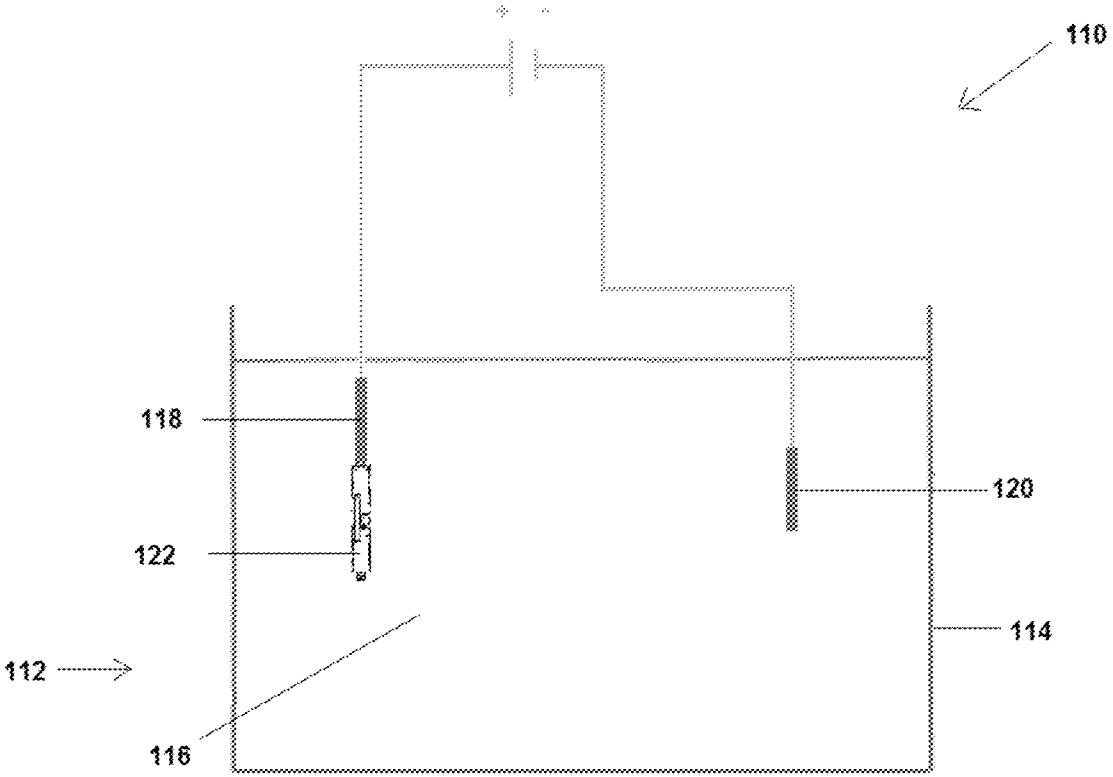
FIG. 8 is a schematic view of an apparatus for forming a corrosion-resistant ceramic-oxide coating on a metallic substrate according to an embodiment of the present disclosure.

Referring to FIG. 8 the apparatus 110 comprises an electrolytic cell 112. The electrolytic cell 112 is adapted to receive the substrate to be coated, during at least one of a electrochemical passivation or plasma electrolytic oxidation. The electrolytic cell 112 includes a housing 114 (also called electrolytic tank) in which an electrically conducting solution 116 is contained. The electrolytic cell 112 also comprises spaced apart electrodes, i.e. an anode 118 and a cathode 120 operable to supply current through the electrically conducting solution 116 between the anode 118 and the cathode 120. The electrodes are connected to a current generator to provide an electrical energy and produce an electrochemical reaction that leads to the formation of the corrosion resistant coating on the substrate. Therefore, in the electrolytic cell 112, the metallic substrate can be immersed in the electrically conducting solution 116 while current is applied between the electrodes 118, 120.

The electrically conducting solution 116 comprises at least one tetrafluoroborate compound. The electrically conducting solution 116 can be used in electrolytic passivation (first solution) and can have a concentration of tetrafluoroborate compound of between 0.1 and 20 g/L. The electrically conducting solution 116 can be used in plasma electrolytic oxidation (second solution) and can have a concentration of tetrafluoroborate compound of between 0.1 and 50 g/L. The tetrafluoroborate compound and the electrically conducting solution 116 are as described herein.

In the embodiment of FIG. 8, the apparatus 110 also comprises a mounting assembly 122 for moving the substrate into the electrically conducting solution 116. The mounting assembly 122 is further illustrated in FIG. 9 and comprises an upper arm 124 adapted to be connected in electrical contact to the anode. The upper arm 124 has a first end 126 that can be connected to the anode in a manner that prevents any movement in relation to the anode.

Figure 9:
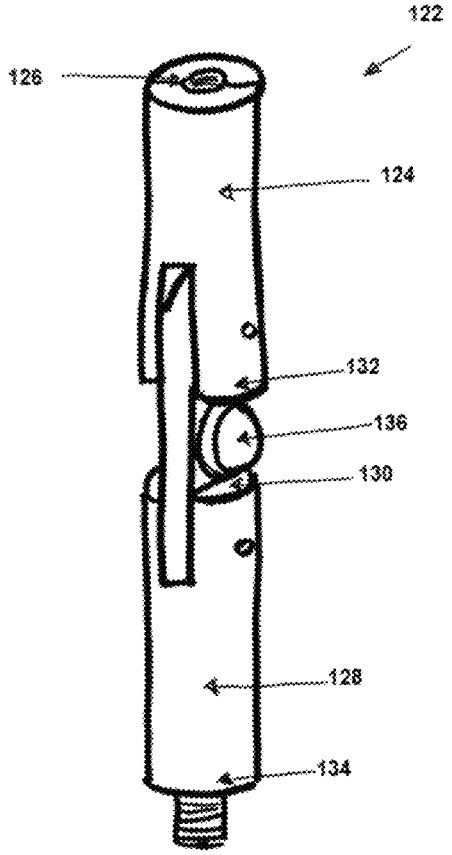
FIG. 9 is a side perspective view of a mounting assembly of the apparatus of FIG. 8.

As shown in FIG. 9, the mounting assembly 122 also comprises a lower arm 128 connected to the upper arm 124 and the substrate. The lower arm 128 has a first end 130 connected in electrical contact to the upper arm 124. More particularly, the first end 130 of the lower arm 128 is connected in electrical contact to a second end 132 of the upper arm 124. The upper and lower arms 124, 128 are connected as to allow movement of the lower arm 128 relative to the upper arm 124. For example, the lower arm 128 may be pivotably connected to the upper arm 124.

Still referring to FIG. 9, the lower arm 128 has a second end 134 adapted to be connected in electrical contact to the substrate to be coated. The second end 134 can comprises a threaded connecting part that ensures good electrical connection between the anode and the metallic substrate and limits the risk for occurrence of arc, which could damage the metallic substrate. The threaded part can be screwed to an existing helical seat of the substrate for example.

Movement of the lower arm 128 relative to the upper arm 124 leads to movement of the substrate within the electrically conducting solution. In the embodiment of FIG. 9, the upper and the lower arms 124, 128 are connected through a connector 136. The connector 136 ensure electrical continuity between the upper and the lower arms 124, 128.

Figure 10A:
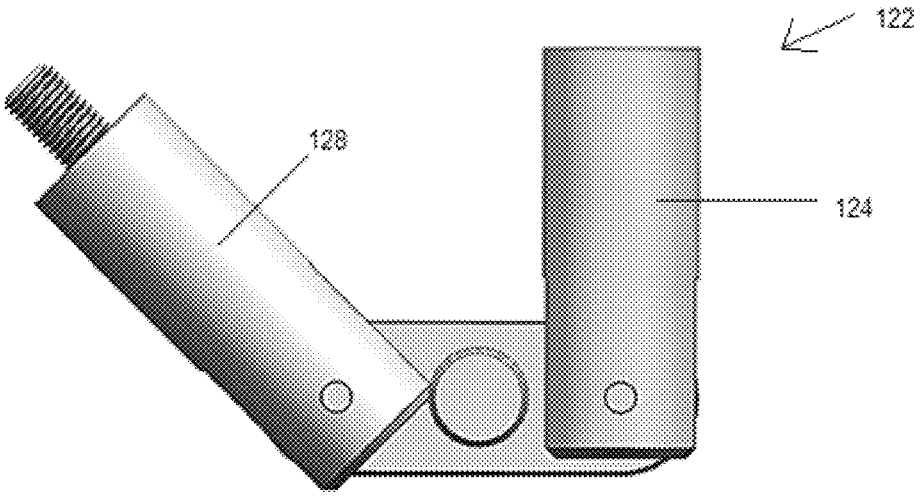
FIG. 10*a* is a side perspective view of the mounting assembly of FIG. 8, showing a lower arm portion thereof in a pivoted position.
Figure 10B:
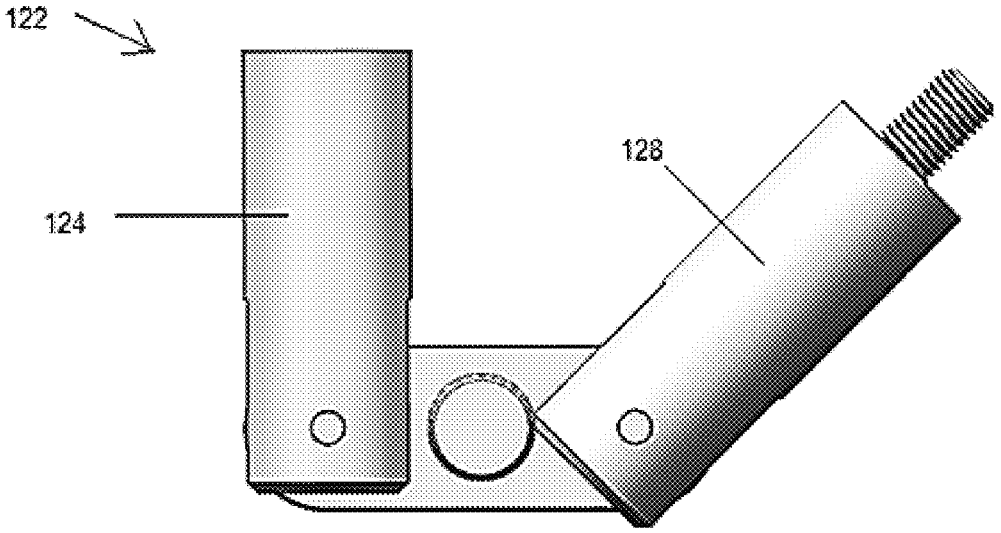
FIG. 10*b* is a side perspective view of the mounting assembly of FIG. 8, showing a lower arm portion thereof in another pivoted position.
Figure 10C:
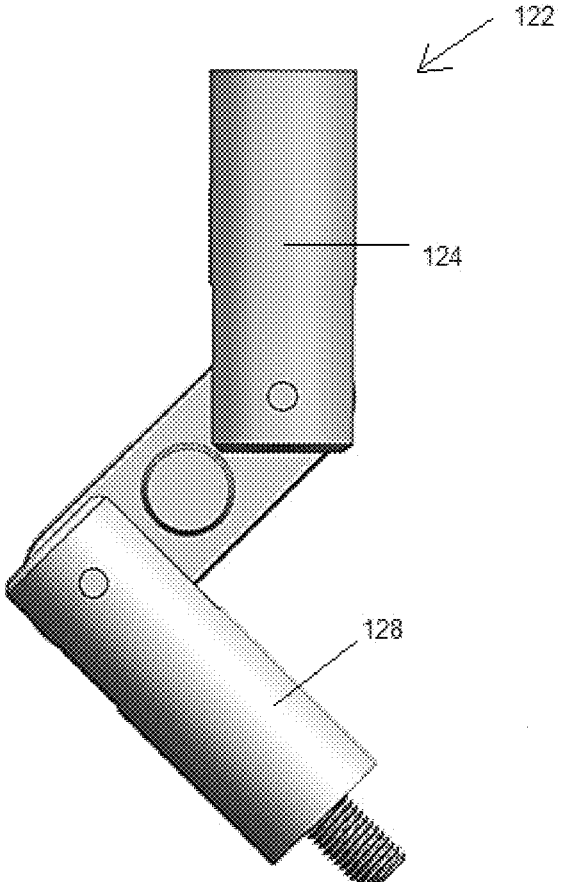
FIG. 10*c* is a side perspective view of the mounting assembly of FIG. 8, showing a lower arm portion thereof in a further pivoted position.

FIGS. 10*a* to 10*c* show that the lower arm 128 of the mounting assembly 122 is movable in an upright direction between at a first position and at least one second position. In the first position the lower arm may define an angle of up to 135°, relative to the upper arm 124. In a particular embodiment, this angle may be about 120°. In the at least second position the lower arm 128 can also define an angle of up to 135° relative to the upper arm 124. In a particular embodiment, this angle may be from 90° to 135°, and more particularly may be about 120°. The first and the second positions can be angularly separated by a total angle of up to 270°. In a particular embodiment, the total angle may be from 180° to 270°.

As shown in FIGS. 10*a* to 10*c*, the connection between the upper arm 124 and the lower arm 128 can be a double pivot connection, allowing for a greater angular rotation of the lower arm relatively to the upper arm.

The mounting assembly 122 can moves between the first and the second positions in a period of time of 0.5 to 1.5 minutes. The mounting assembly 122 allows rotation of the substrate to be coated in relation to the anode by a total angle of at least 180°. When the substrate has complicated spatial shape and complicated surface configuration, through holes and/or blind holes and/or deep cavities, movement of the substrate within the electrically conducting solution provides a corrosion-resistant coating having uniform thickness and reproducible properties regardless of the geometry of the substrate.

Figure 11:
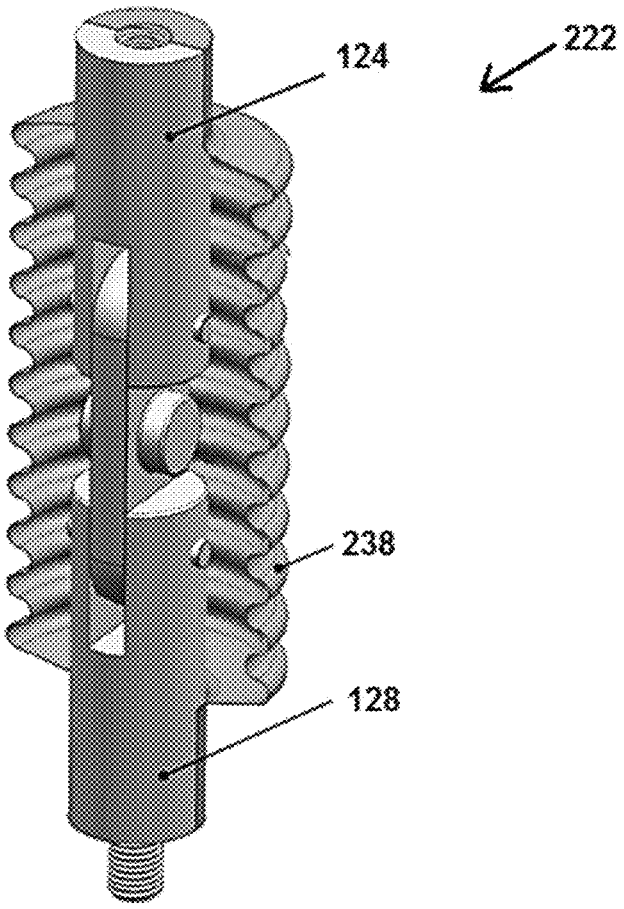
FIG. 11 is a partially sectioned, side perspective view of a mounting assembly of the apparatus of FIG. 8.

Referring to FIG. 11, a mounting assembly 222 in accordance with another embodiment is shown, where elements similar to that of the mounting assembly 122 are referred to using the same reference numeral and will not be described further herein. In the particular embodiment of FIG. 11, the mounting assembly 222 comprises a joint cover 238 protecting the connection between the upper arm 124 and the lower arm 128 against damage from the electrically conducting solution.

Figure 12:
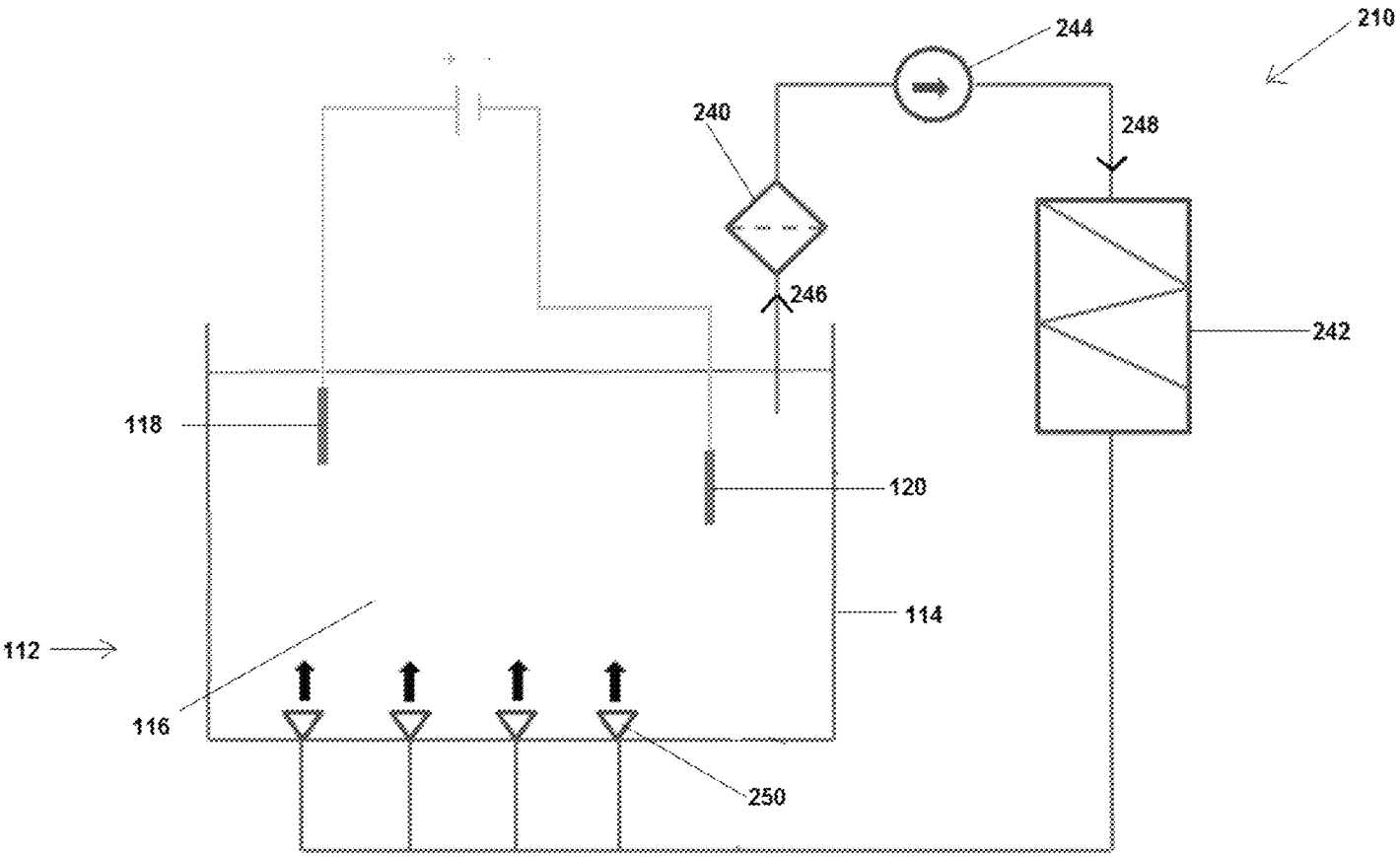
FIG. 12 is a schematic view of an apparatus for forming a corrosion-resistant ceramic-oxide coating on a metallic substrate according to another embodiment of the present disclosure.

Referring to FIG. 12, an apparatus 210 in accordance with another embodiment is shown, where elements similar to that of the apparatus 110 are referred to using the same reference numeral and will not be described further herein. In the embodiment of FIG. 12, the apparatus 210 further comprises a filter 240, a heat exchanger 242 and a flow generating device 244. The filter 240 is connected to the electrolytic cell 112 and receives a stream 246 of the electrically conducting solution 116 from the electrolytic cell 112. The electrically conducting solution 116 can therefore be filtered after reaction of the electrolyte with the substrate.

As shown in FIG. 12, the heat exchanger 242 can be connected downstream the filter 240. Heat is then removed from the filtered stream of electrically conducting solution 248 that is passing through the heat exchanger 242. Therefore, the temperature of the electrically conducting solution 116 can be controlled. For example, during plasma electrolytic oxidation, the temperature of the electrically conducting solution 116 can be kept between 3 and 7° C. The flow generating device 244 is operably connected to the electrolytic cell 112 and allow circulation of the electrically conducting solution 116 around the substrate, and of the streams 246, 248 from the electrolytic cell 112 to the filter 240 and the heat exchanger 242, and from the filter 240 and heat exchanger 242 back to the electrolytic cell 112.

The flow generating device 244 can be a pump or a compressor. As illustrated in FIG. 12, stirring and circulation of the electrically conducting solution 116 is applied using a pump 244, which forces the electrically conducting solution 116 through nozzles 250 situated at the bottom of the housing 114 (or electrolytic tank). The electrically conducting solution 116 can therefore flows around the substrate. In the embodiment of FIG. 12, the electrically conducting solution 116 is received from an upper part of the housing 114 and is pumped by the pump 244 through the filter 240 and a heat exchanger 242. The temperature of the electrically conducting solution exiting the heat exchanger 242 is lower than 4° C. Then the electrically conducting solution 116 is pumped back to the housing 114 through the nozzles 250 located in the bottom part of the housing 114. The circulation of the electrically conducting solution 116 can also be achieved using a compressor delivering compressed air. In such case, the nozzles supply compressed oxygen or compressed air as to put the electrically conducting solution is motion.

Figure 13:
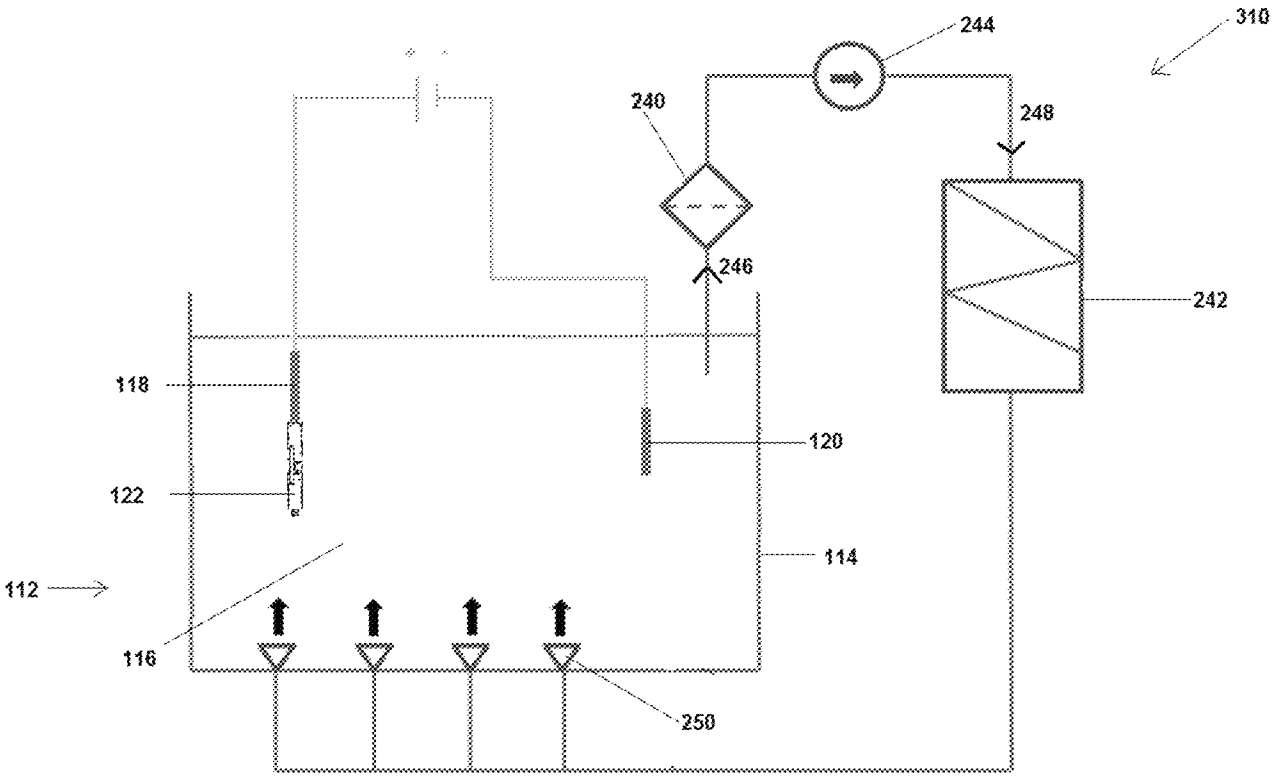
FIG. 13 is a schematic front view of an apparatus for forming a corrosion-resistant ceramic-oxide coating on a metallic substrate according to a further embodiment of the present disclosure.
Figure 14A:
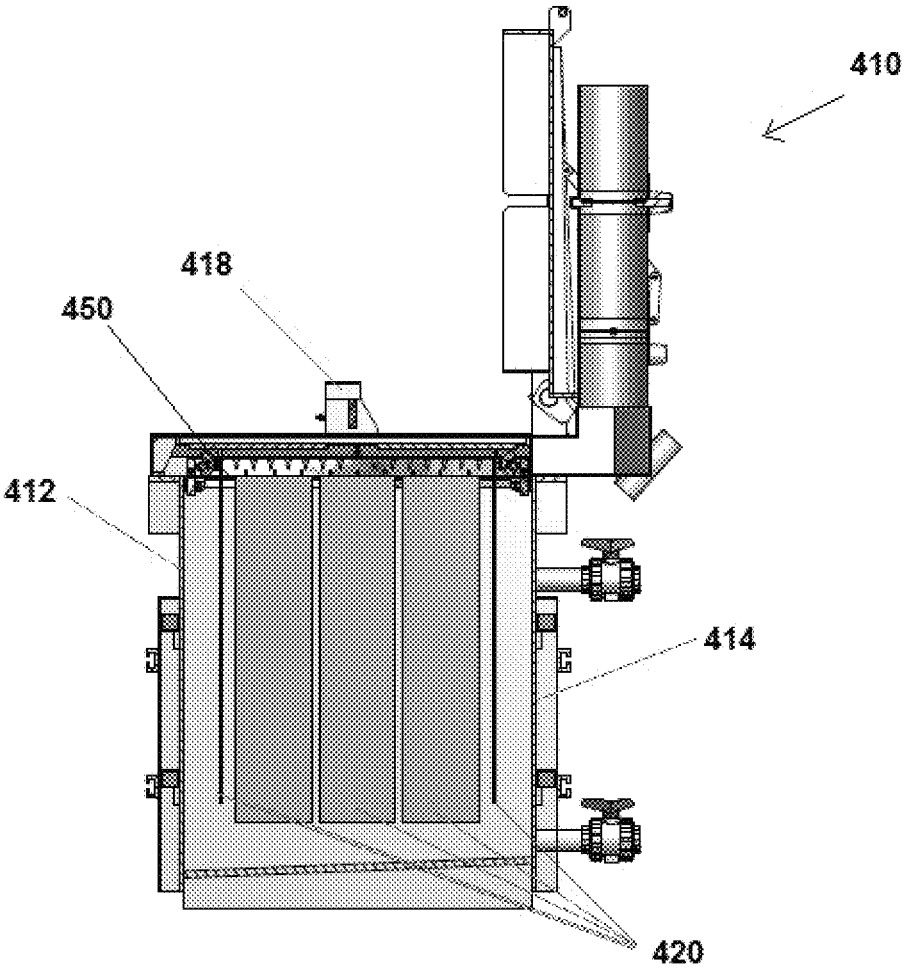
FIG. 14*a* is a schematic side perspective view of an apparatus for forming a corrosion-resistant ceramic-oxide coating on a metallic substrate according to yet a further embodiment of the present disclosure.
Figure 14B:
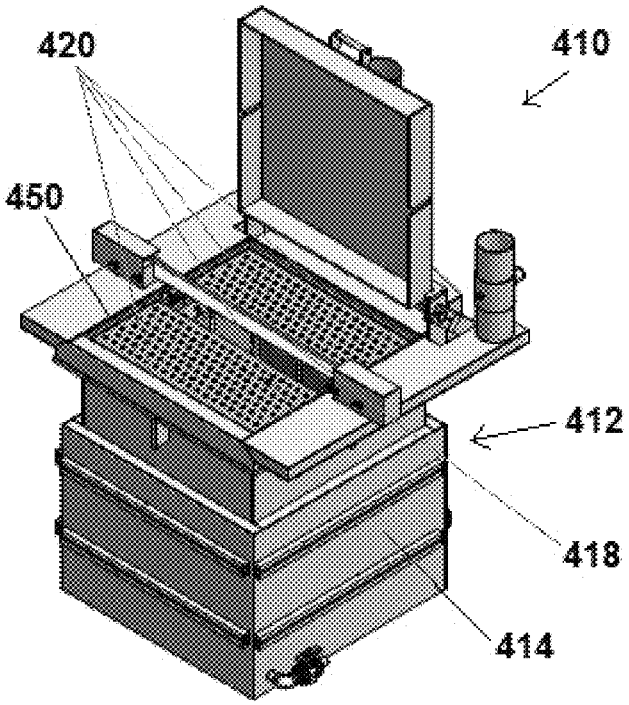
FIG. 14*b* is a schematic side perspective view of the apparatus of FIG. 14*a;*
Figure 14C:
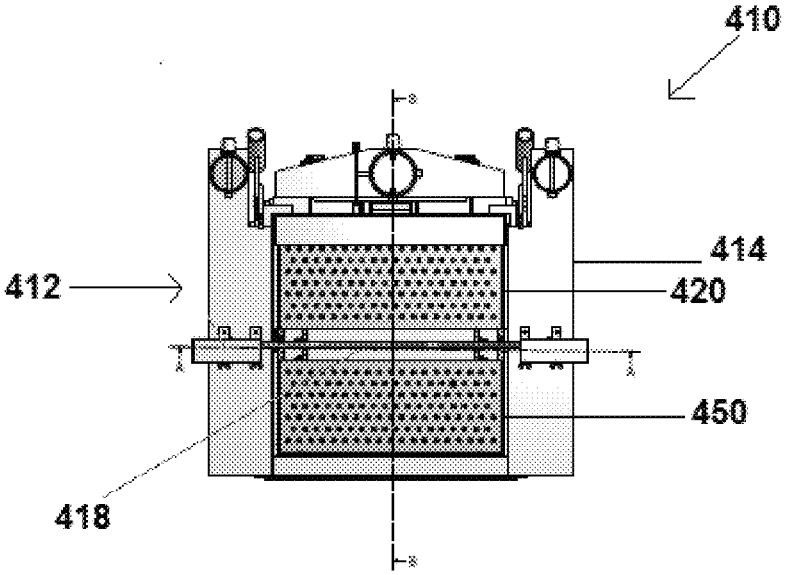
FIG. 14*c* is a schematic top perspective view of the apparatus of FIG. 14*a;*
Figure 14D:
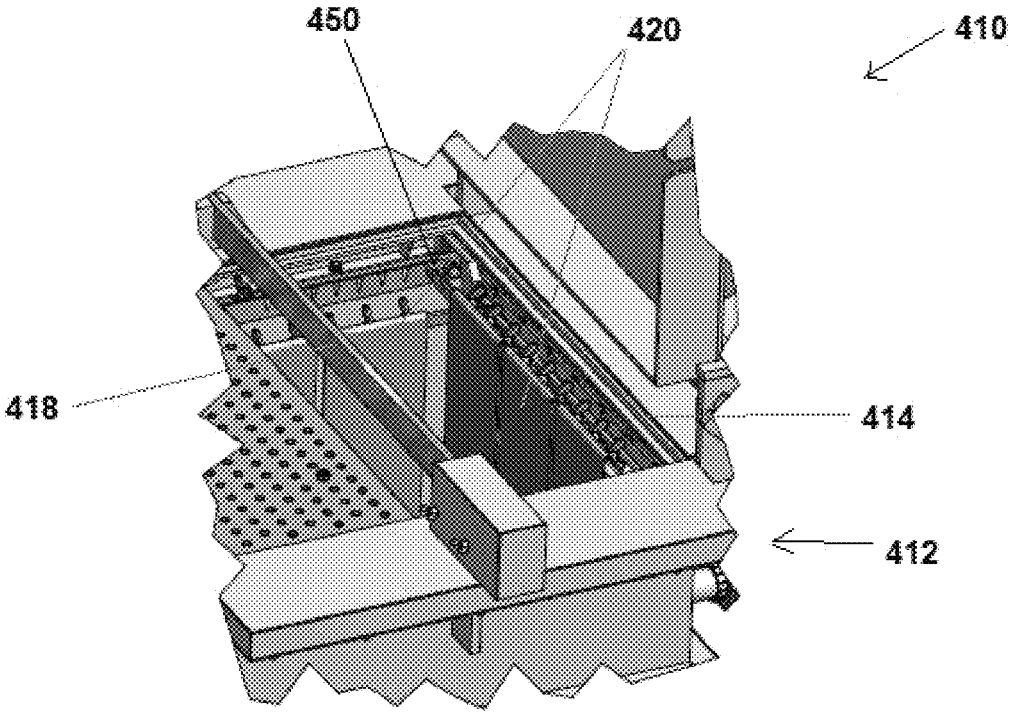
FIG. 14*d* is a schematic side perspective view of a part of the apparatus of FIG. 14*a;*

Referring to FIG. 13 an apparatus 310 in accordance with another embodiment is shown, where elements similar to that of the apparatus 110, 210 are referred to using the same reference numeral and will not be described further herein. In the embodiment of FIG. 13, the apparatus 310 comprises the mounting assembly 122, the filter 240, the heat exchanger 242 and the flow generating device 244. Therefore, the substrate can be moved within the electrolytic cell 112 while the electrically conducting solution 116 is circulated around the substrate and through the filter 240 and the heat exchanger 242.

Referring to FIGS. 14*a* to 14*d*, an apparatus 410 in accordance with another embodiment is shown. The apparatus 410 includes an electrolytic cell 412 comprising a plurality of cathode bars 420, made of divided plates (cathode plates), which are placed all around the housing 414, parallel to the walls of the housing 414. The apparatus 410 also comprises an anodic bar 418 disposed at a top end of the electrolytic cell 412. It can be seen from FIGS. 14*b* to 14*d* that the anodic bar can be located at the top end of the electrolytic cell, along a central axis relative to open end of the housing 414. As shown in FIGS. 14*a* to 14*d*, the cathode plates 420 can be disposed all around the housing using a cathode frame 450. The cathode frame is adapted to allow disposing the cathode bars around the housing. The current is delivered to the substrate to be coated between the anode bar 418 and the cathode plates 420. A mounting assembly, as defined herein, can be provided within the electrolytic cell. The mounting assemble can have an upper arm and a lower arm. In such scenario, one end of the upper arm of the mounting assembly is connected in electrical contact with the anode bar 418. The anode bar 418 therefore hold the substrate to be coated and provide electrical current to the substrate through the mounting assembly.

Figure 15:
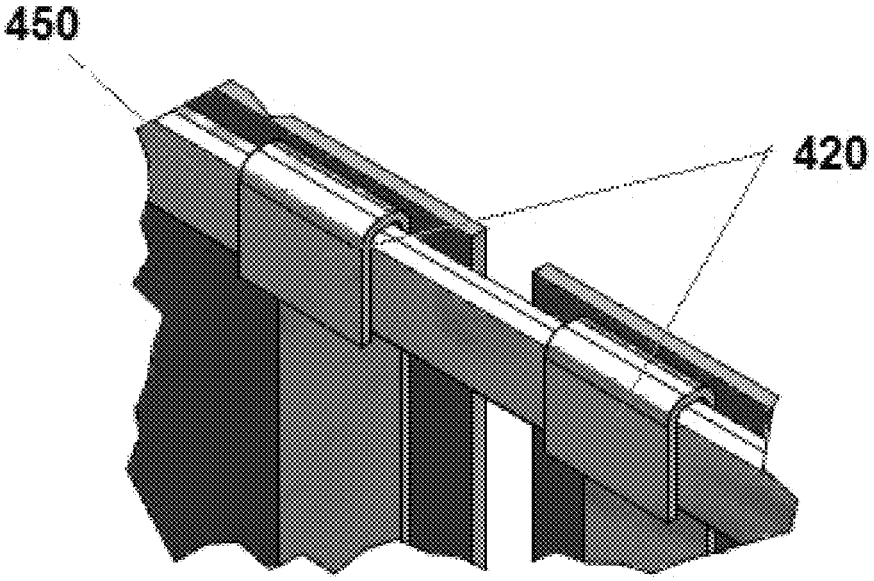
FIG. 15 is a schematic side perspective view of cathode bars in the apparatus of FIG. 14*a*.
Figure 16:
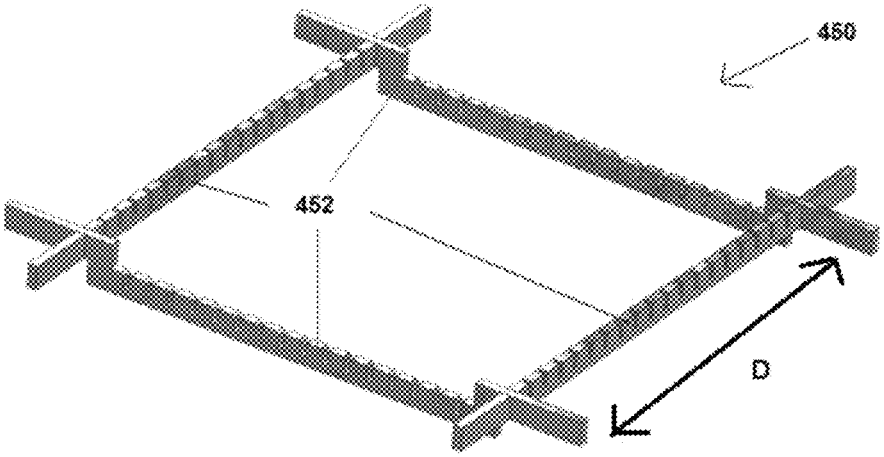
FIG. 16 is a schematic side perspective view of cathode frame in the apparatus of FIG. 14*a*.

Referring to FIG. 15, the plurality of cathode plates 420 can be moved along the cathode frame 450. The cathode plates 420 can be reversibly hung on the cathode frame 450 for example. Therefore, the space between two adjacent cathode plates 420 can be controlled. As shown in FIG. 16, the cathode frame 450 comprises cathode frame portions 452 that are movable relative to each other, so that the space between two parallel and facing cathode plates 420 can also be controlled.

In FIG. 16, the cathode frame portions 452 of the cathode frame 450 comprise connecting features that allow adapting and controlling the distance D between to facing cathodes frame portions 452. The cathode frame portions 452 can be connected using fixtures, indentations, or interlocks for example. Using movable cathode frame portions 452 allows adapting the space between the cathodes that are hung on the cathode frame 450 and the outermost surface of the metallic substrate to be coated, depending on the shape and size of the metallic substrate. It is contemplated that this leads to a more uniform deposition of ceramic coating on the metallic substrate.

The above description is meant to be exemplary only, and one skilled in the art will recognize that changes may be made to the embodiments described without departing from the scope of the invention disclosed. For example, any suitable material having the properties described with respect to the aluminide layer, bond layer or ceramic layer may be used. Any suitable method of applying the different layers may be used. Still other modifications which fall within the scope of the present invention will be apparent to those skilled in the art, in light of a review of this disclosure, and such modifications are intended to fall within the appended claims.

What is claimed is:

1. A method of forming a corrosion-resistant ceramic coating on a metallic substrate, the method comprising:

providing a passivation layer on a surface of the metallic substrate by electrochemical passivation of the metallic substrate under a first electrical current at a voltage of between 1 and 120 V and using a first electrically conducting solution; and forming the corrosion-resistant ceramic coating on an outermost surface of the metallic substrate by plasma electrolytic oxidation of the metallic substrate with the passivation layer, in a second electrically conducting solution and under a second electrical current having a discharge voltage, the outermost surface in use adapted to be exposed to a corrosive environment;

wherein the first and the second electrically conducting solutions comprise a tetrafluoroborate compound.

2. The method as defined in claim 1, further comprising selecting the tetrafluoroborate compound from the group consisting of potassium tetrafluoroborate, sodium tetrafluoroborate, lithium tetrafluoroborate, ammonium tetrafluoroborate, and combinations.

3. The method as defined in claim 1, wherein the electrochemical passivation and the plasma electrolytic oxidation are performed separately, and the first and the second electrically conducting solutions are different solutions.

4. The method as defined in claim 3, wherein the first electrically conducting solution has a tetrafluoroborate concentration of 0.1 to 50 g/L.

5. The method as defined in claim 3, wherein the second electrically conducting solution has a tetrafluoroborate concentration of 0.1 to 20 g/L.

6. The method as defined in claim 1, wherein at least the second electrically conducting solution is circulated to flow around the substrate.

7. The method as defined in claim 1, further comprising moving the substrate during at least plasma electrolytic oxidation in the second electrically conducting solution.

8. The method as defined in claim 7, further comprising continuously moving the substrate in the second electrically conducting solution.

9. The method as defined in claim 7, wherein the substrate is moved by continuous flow of the first electrically conducting solution and/or the second electrically conducting solution around the substrate.

10. The method as defined in claim 1, wherein the plasma electrolytic oxidation is an electrolytic spark discharge oxidation and the discharge current is injected through the second solution by impulse, each impulse having an impulse time divided into a flow-on time, during which a current passes through the second solution, and a flow-off time, during which no current passes through the second electrically conducting solution, and selecting the ratio between the flow-on time and the impulse time to be from 10% to 100%.

11. The method as defined in claim 10, further comprising selecting the ratio between the flow-on time and the impulse time to be from 30% to 40%.

12. The method as defined in claim 1, further comprising adapting a distance between the outermost surface of the substrate to be coated and at least one electrode delivering at least one of the first electrical current and the second electrical current.

13. The method of claim 1 wherein the passivation layer comprises a fluoride.

14. The method as defined in claim 13, wherein the tetrafluoroborate compound comprises lithium tetrafluoroborate and/or ammonium tetrafluoroborate.

15. The method as defined in claim 13, wherein the tetrafluoroborate compound comprises ammonium tetrafluoroborate.

16. The method of claim 1 wherein the passivation layer is a fluoride layer.

17. The method as defined in claim 16, wherein the tetrafluoroborate compound comprises lithium tetrafluoroborate.

18. The method as defined in claim 16, wherein the tetrafluoroborate compound comprises ammonium tetrafluoroborate.

19. The method as defined in claim 1, wherein the tetrafluoroborate compound comprises lithium tetrafluoroborate.

20. The method as defined in claim 1, wherein the tetrafluoroborate compound comprises ammonium tetrafluoroborate.

* * * * *